US011511841B2

(12) United States Patent
Weber et al.

(10) Patent No.: US 11,511,841 B2
(45) Date of Patent: Nov. 29, 2022

(54) ELECTRICALLY ASSISTED HYDRAULIC STEERING SYSTEM

(71) Applicant: Steering Solutions IP Holding Corporation, Saginaw, MI (US)

(72) Inventors: John E. Weber, Pinconning, MI (US); Rodney M. Sanderson, Beaverton, MI (US); Brian G. Maust, Unionville, MI (US)

(73) Assignee: Steering Solutions IP Holding Corporation, Saginaw, MI (US)

( * ) Notice: Subject to any disclaimer, the term of this patent is extended or adjusted under 35 U.S.C. 154(b) by 0 days.

(21) Appl. No.: 17/197,362

(22) Filed: Mar. 10, 2021

(65) Prior Publication Data

US 2021/0284314 A1 Sep. 16, 2021

Related U.S. Application Data

(60) Provisional application No. 62/987,735, filed on Mar. 10, 2020.

(51) Int. Cl.
*B63H 25/30* (2006.01)
*B63H 25/24* (2006.01)

(52) U.S. Cl.
CPC ..... *B63H 25/24* (2013.01); *B63H 25/30* (2013.01)

(58) Field of Classification Search
CPC ..... B63H 25/22; B63H 25/24; B62D 5/0409; B62D 5/0412; B62D 5/0415; B62D 5/06; B62D 5/061; B62D 5/14
See application file for complete search history.

(56) References Cited

U.S. PATENT DOCUMENTS

2012/0125141 A1* 5/2012 Rosenmaier ..... G09B 9/02 74/499
2012/0132120 A1* 5/2012 Gai ..... B63H 25/22 114/150
2017/0283026 A1* 10/2017 Gai ..... B62D 5/0409
2019/0039708 A1* 2/2019 Hayes ..... B63H 25/34
2021/0339797 A1* 11/2021 Carreirao ..... B62D 5/09

* cited by examiner

*Primary Examiner* — Andrew Polay
(74) *Attorney, Agent, or Firm* — Dickinson Wright PLLC

(57) ABSTRACT

A steering system for a marine craft includes a steering input shaft. The steering system also includes an electric power steering (EPS) system operatively coupled to the steering input shaft, the EPS system having an electric motor that drives rotation of a system output shaft. The steering system further includes a hydraulic pump operatively coupled to the system output shaft with a gear set, the hydraulic pump having a longitudinal direction that is perpendicular to a steering input shaft axis. The steering system yet further includes a fluid reservoir located remotely relative to the hydraulic pump.

8 Claims, 3 Drawing Sheets

ELECTRICALLY ASSISTED HYDRAULIC STEERING SYSTEM

CROSS-REFERENCE TO RELATED APPLICATION

This application claims the benefit of priority to U.S. Provisional Patent Application Ser. No. 62/987,735, filed Mar. 10, 2020, the disclosure of which is incorporated by reference herein in its entirety.

FIELD OF THE INVENTION

The disclosure herein relates to steering systems and, more particularly, to an electrically assisted hydraulic steering system.

BACKGROUND

Some non-automotive vehicle power steering systems involve a manual hydraulic pump that is attached to the steering wheel of a vehicle. The pump is connected via hoses to opposite sides of a cylinder—or cylinders—which stroke and thus turn the wheels/rudder/propulsion device when fluid is pumped (e.g., steering wheel/pump is turned). In larger systems, high effort is often required to turn the wheel, and consequently the vehicle.

To reduce the above-described high effort, various powered steering systems have been developed, but most are expensive and complicated. The most common system utilizes a hydraulic pump running via a belt off the main propulsion engine. When the steering effort becomes high, as determined by a flow/pressure switch, then pressurized fluid is metered into the system to facilitate turning of the vehicle. Another similar method often used on watercraft is an electro-hydraulic system where a small electric motor runs a pump to supply high pressure fluid in a similar fashion as that described above in connection with the purely hydraulic system.

Shortcomings of the above-described systems include low efficiency due to parasitic losses by the running of pumps; high investment cost due to many extra parts, such as hoses, pumps, motors, connectors, etc.; high installation cost due to extra part inventory; high installation weight; and an inherently simple on/off nature, with no programmability or flexibility.

SUMMARY OF THE DISCLOSURE

According to one aspect of the disclosure, a steering system for a marine craft includes a steering input shaft. The steering system also includes an electric power steering (EPS) system operatively coupled to the steering input shaft, the EPS system having an electric motor that drives rotation of a system output shaft. The steering system further includes a hydraulic pump operatively coupled to the system output shaft with a gear set, the hydraulic pump having a longitudinal direction that is perpendicular to a steering input shaft axis. The steering system yet further includes a fluid reservoir located remotely relative to the hydraulic pump.

According to another aspect of the disclosure, a steering system for a marine craft includes a steering input shaft. The steering system also includes an electric power steering (EPS) system operatively coupled to the steering input shaft, the EPS system having a system output shaft. The steering system further includes a hydraulic pump having the system output shaft of the EPS system coupled to a nut-piston within a pump case. The steering system yet further includes a fluid reservoir located remotely relative to the hydraulic pump.

According to yet another aspect of the disclosure, a method of operating a steering system for a marine craft is provided. The method includes operatively connecting an electric power steering (EPS) system with a steering input shaft. The method also includes operatively connecting the EPS system to fluid pump, the fluid pump oriented perpendicular to an electric motor of the EPS system. The method further includes providing one or more driver interaction functions with a controller of the EPS system.

These and other advantages and features will become more apparent from the following description taken in conjunction with the drawings.

BRIEF DESCRIPTION OF THE DRAWINGS

The subject matter that is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Referring now to the Figures, where the invention will be described with reference to specific embodiments, without limiting same, an exemplary embodiment of a steering system for a vehicle is illustrated and referenced generally with numeral 10. The embodiments disclosed herein would benefit a marine vehicle, such as a watercraft. However, it is contemplated that various other vehicles, such as a car, truck, sport utility vehicle, crossover, mini-van, marine craft, aircraft, all-terrain vehicle, recreational vehicle, or other suitable vehicles, may also benefit from the embodiments disclosed herein.

Figure 1:
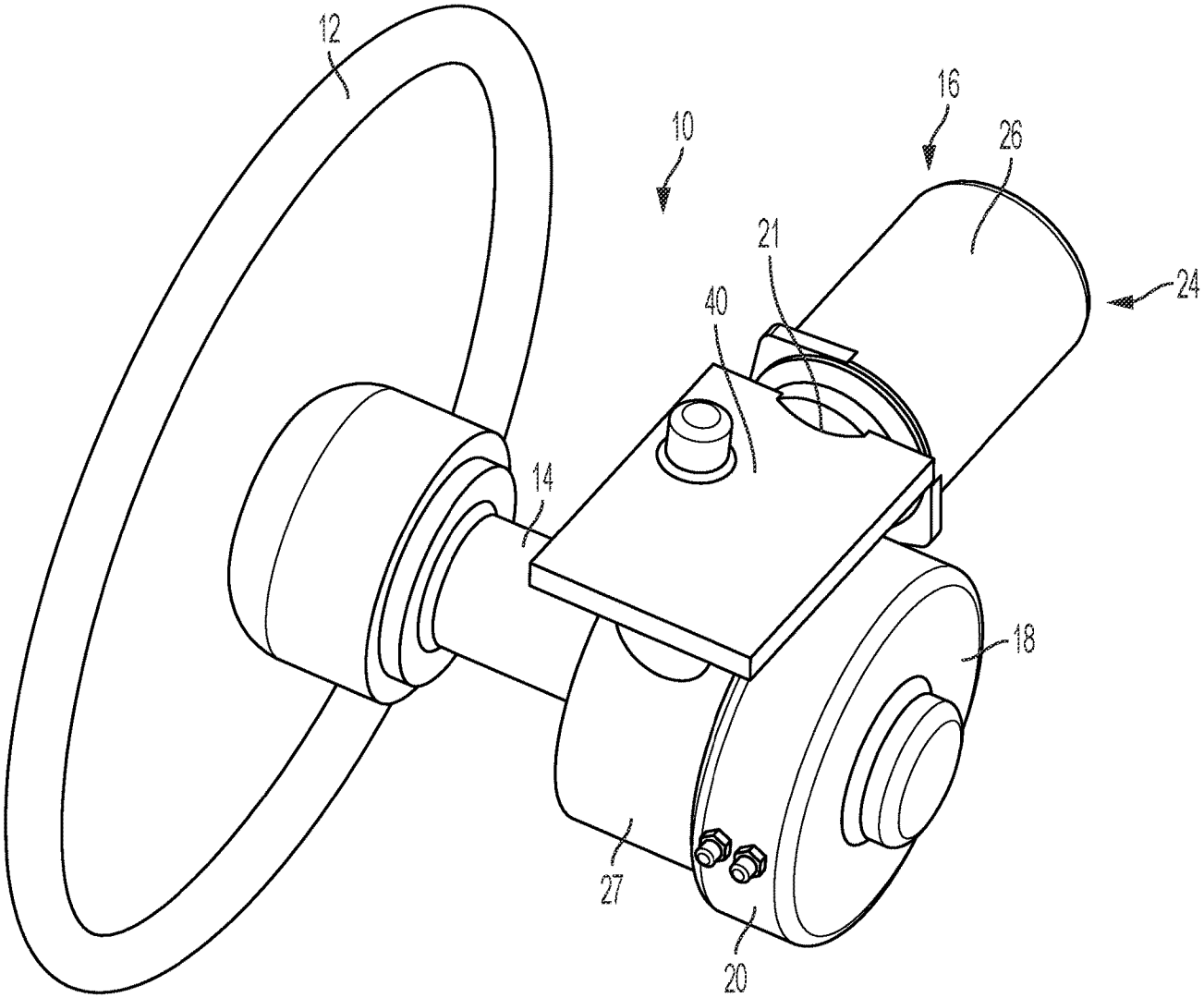
FIG. 1 is a perspective view of an electrically assisted hydraulic steering system.

Referring to FIG. 1, the vehicle steering system 10 includes at least one manual steering input member 12 (may also be referred to herein as a "steering device 12"). The manual steering input member 12 may be any suitable device that an operator manually interacts with to effect steering of the vehicle. In the illustrated example, the manual steering input member is in the form of a steering handwheel. The manual steering input member 12 is fitted on the end of an input shaft 14 of an electro-hydraulic steering assist system, the electro-hydraulic steering assist system referred to generally with numeral 16. The electro-hydraulic steering assist system 16 includes an electric power steering (EPS) system 24 and a hydraulic assist portion 18. The interaction between the input shaft 14, the EPS system 24 and the hydraulic assist portion 18 is described in detail herein.

The input shaft 14 extends towards and into operative contact with the EPS system 24. In particular, a portion of the input shaft 14 extends into a housing 27 of the EPS system 24.

Figure 2:
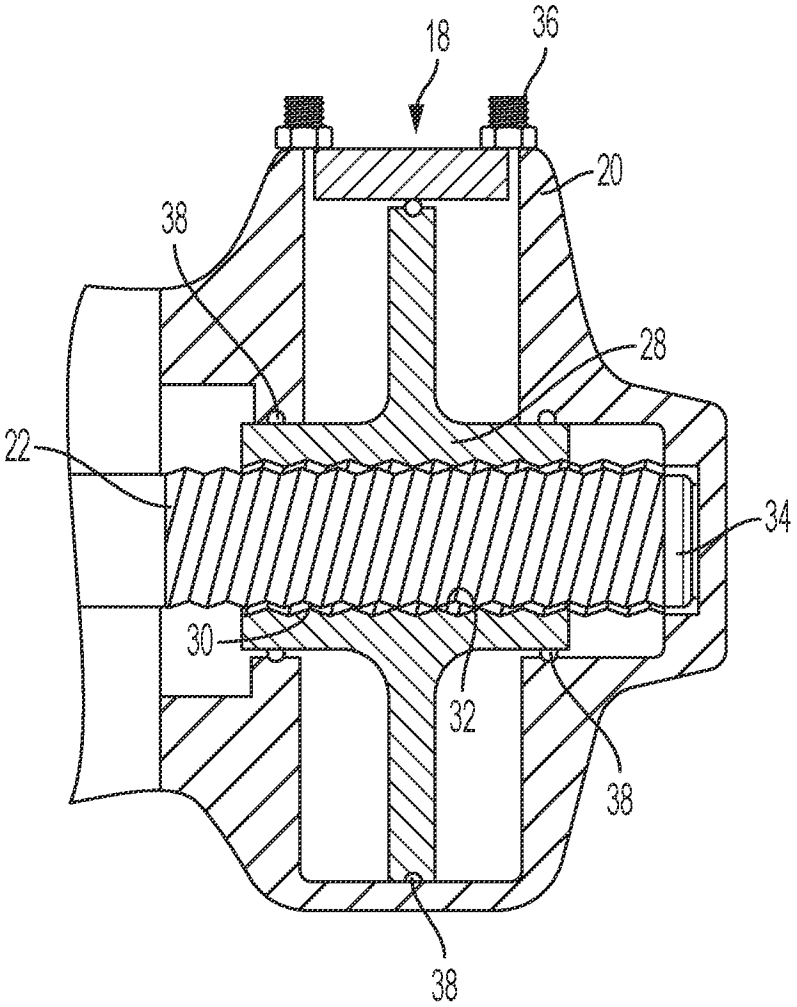
FIG. 2 is a cross-sectional view of the electrically assisted hydraulic steering system.

Referring now to FIG. 2, with continued reference to FIG. 1, an electric motor 26 of the EPS system 24 includes a motor output shaft 21 that engages a gear set (not shown) disposed within the housing 27. The motor output shaft 21 is oriented substantially perpendicular to the steering input device axis. The gear set interacts with a system output shaft 22, and upon actuation by the electric motor 26, the motor output shaft 21 and the gear set drives the system output shaft 22 into rotatable motion.

The system output shaft 22 extends into a case 20 of the hydraulic assist portion 18—and along the steering input shaft axis or substantially parallel thereto. The case 20 of the hydraulic assist portion 18 may be located immediately adjacent the housing 27 of the EPS system 24 or may integrated within a larger EPS system housing in some embodiments. The system output shaft 22 engages a nut-piston 28 of the hydraulic pump 18 that is housed within the case 20. In the illustrated embodiment, the system output shaft 22 includes a threaded outer portion 30 that is engaged with a threaded inner portion 32 of the nut-piston 28. Since the system output shaft 22 is translationally fixed via a bushing and/or bearing 34 located at and end of the system output shaft 22, the rotation of the system output shaft 22 translates the nut-piston 28 therealong due to the threaded engagement of the components. Various seals 38 are provided within the case 20 to ensure appropriate sealing within the pump 18.

In operation, the steering device 12 is rotated and interacts with the EPS system 24 to initiate actuation of the EPS system 24 for steering assistance. The EPS system 24 also provides controlled feedback to the steering device 12, thereby making the steering effort more pleasant. As the EPS system 24 assists with operation of the pump 18 to alleviate a requirement for manual adjustment of the pump 18, a fluid, such as oil, to be pressurized and leaves the pump 18 via hoses to a steering cylinder. The hoses are attached to the pump 18 at fluid ports 36.

This fluid causes the steering cylinder on the vehicle to turn in the predicted manner dictated by the steering wheel direction. The EPS system 24 supplies assist torque to the pump 18 to reduce the torque required by the operator to steer the vehicle/vessel. The fluid (e.g., oil) reservoir can be mounted remotely unlike other integrated designs. This feature also reduces the size and weight of the system.

Figure 3:
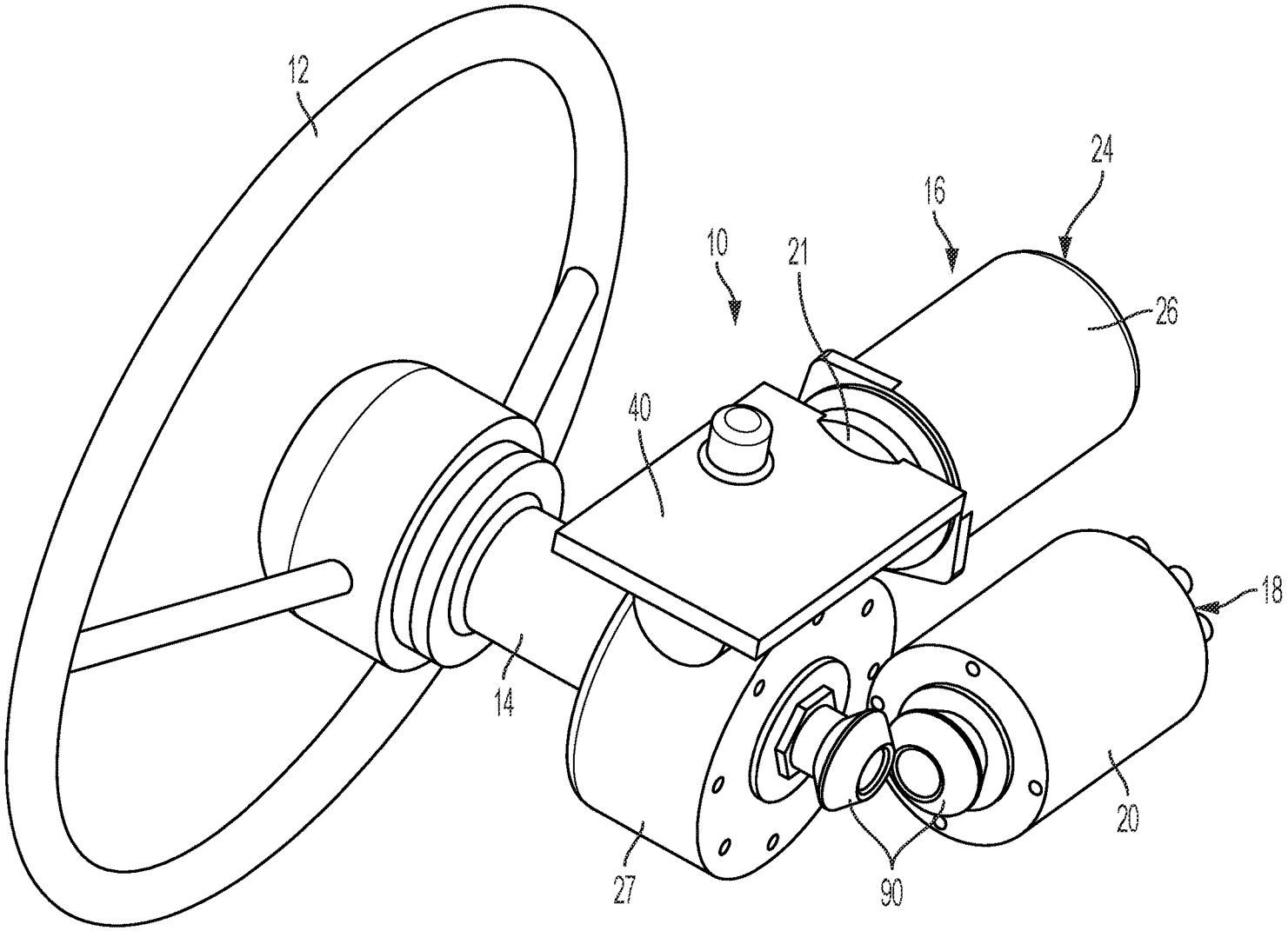
FIG. 3 is a perspective view of the electrically assisted hydraulic steering system according to another aspect of the disclosure.

Referring now to FIG. 3, the vehicle steering system 10 is illustrated to show another aspect of the disclosure. As with the embodiments described above, the steering system 10 includes the steering device 12. The steering device 12 is fitted on the end of the input shaft 14 of the electro-hydraulic steering assist system 16. The electro-hydraulic steering assist system 16 includes an electric power steering (EPS) system 124 and a hydraulic assist portion 118. The interaction between the input shaft 14, the EPS system 124 and the hydraulic assist portion 118 according to FIG. 3 is described in detail herein.

The input shaft 14 extends towards and into operative contact with the EPS system 124. In particular, a portion of the input shaft 14 extends into a first side of the housing 27 of the EPS system 124. The electric motor 26 of the EPS system 124 includes a motor output shaft 21 that extends into the housing 27 to drive a system output shaft 122. The motor output shaft 21 is oriented substantially perpendicular to the steering input device axis. Upon actuation by the electric motor 26, the motor output shaft 21 drives the system output shaft 22 into rotatable motion.

The system output shaft 22 is operatively coupled to a gear set 90 at an end of the system output shaft 22. The gear set 90 may be a bevel gear or any other suitable gear arrangement. The gear set 90 transfers power from the rotating motion of the system output shaft 22 to a component that drives a hydraulic pump that is part of the hydraulic assist portion 118.

The hydraulic pump is oriented substantially perpendicular to the steering input device axis. Various compact packaging options are available with the disclosed relative orientation of the hydraulic pump.

In operation, the steering device 12 is rotated and interacts with the EPS system 124 to initiate actuation of the EPS system 124 for steering assistance. The EPS system 124 also provides controlled feedback to the steering device 12, thereby making the steering effort more pleasant. As the EPS system 124 assists with operation of the pump 18 to alleviate a requirement for manual adjustment of the pump 18, a fluid, such as oil, to be pressurized and leaves the pump 18 via hoses to a steering cylinder. The hoses are attached to the pump 18 at fluid ports.

This fluid causes the steering cylinder on the vehicle to turn in the predicted manner dictated by the steering wheel direction. The EPS system 24 supplies assist torque to the pump 18 to reduce the torque required by the operator to steer the vehicle/vessel. The fluid (e.g., oil) reservoir can be mounted remotely unlike other integrated designs. This feature also reduces the size and weight of the system.

In any of the embodiments described herein, a controller 40 (FIGS. 1 and 3) associated with the electric power steering (EPS) system 24, 124 may be programmed to provide end stop protection rather than having the piston physically stop abruptly into the end of the case 20, or at a structural interface located within the case 20. The end of travel position could be programmed to reduce assist as the ends of travel are reached. Additionally, the end of travel position(s) could be a learned algorithm that is continuously correcting as the system is operated.

Various other benefits may be achieved. For example, vehicle speed dependent steering sensitivity may be utilized. As the vehicle speed increases, the amount of assist could be decreased to provide a more stable, safer operation. Additionally, haptic feedback messages, warnings, faults or the like could be haptically communicated through the steering device 12 or to an electronic display. The controller 40 could easily accept steering signals from a remote electronic second helm, could offer an operator a selectable steering feel, could transmit a handwheel angle to an electronic display, could offer a return to center feature, and could be programmed to provide pump health diagnostics.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

Having thus described the invention, it is claimed:

1. A steering system for a marine craft comprising:

a steering input shaft;

an electric power steering (EPS) system operatively coupled to the steering input shaft, the EPS system having an electric motor that drives rotation of a system output shaft;

a hydraulic pump operatively coupled to the system output shaft with a gear set, the hydraulic pump having a longitudinal direction that is perpendicular to a steering input shaft axis; and a fluid reservoir located remotely relative to the hydraulic pump.

2. The steering system of claim 1, wherein the motor output shaft is oriented perpendicularly to the steering input shaft.

3. The steering system of claim 1, wherein the motor output shaft and the system output shaft are oriented perpendicularly relative to each other.

4. The steering system of claim 1, wherein the pump case is oriented parallel to the electric motor.

5. The steering system of claim 1, wherein the EPS system is in operative communication with a controller.

6. The steering system of claim 5, further comprising a nut-piston assembly, wherein a nut of the nut-piston assembly is coupled to the system output shaft, wherein at least one end stop position of the nut-piston assembly is programmed into the controller.

7. The steering system of claim 5, wherein the controller provides haptic feedback to the steering input shaft.

8. The steering system of claim 5, wherein the controller provides one or more electronic indicators related to operation of the hydraulic pump.

* * * * *